United States Patent [19]

Howorth

[11] 4,137,831

[45] Feb. 6, 1979

[54] CLEAN AIR ZONE

[75] Inventor: Frederick H. Howorth, Chorley, England

[73] Assignee: Howorth Air Engineering Limited, Lancashire, England

[21] Appl. No.: 786,005

[22] Filed: Apr. 8, 1977

Related U.S. Application Data

[63] Continuation-in-part of Ser. No. 758,926, Jan. 13, 1977, Pat. No. 4,094,232.

[30] Foreign Application Priority Data

May 8, 1976 [GB] United Kingdom ..... 19024/76

[51] Int. Cl.[2] ..... F24F 9/00

[52] U.S. Cl. ..... 98/36; 98/40 D; 128/1 R; 55/DIG. 29

[58] Field of Search ..... 98/36, 8, 40 D, 32, 98/33 R, 33 A, 42 R; 128/1 R; 55/DIG. 29

[56] References Cited

U.S. PATENT DOCUMENTS

| | | | |
|---|---|---|---|
| Re. 25,216 | 8/1962 | Kennedy | 98/40 D |
| 3,380,369 | 4/1968 | Allander | 98/36 |
| 3,631,788 | 1/1972 | Larfeldt | 98/40 D |
| 3,721,067 | 3/1973 | Agnew | 98/36 |
| 3,726,203 | 4/1973 | Lindestrom | 98/36 |
| 3,726,204 | 4/1973 | Lindestrom | 98/36 |
| 3,760,708 | 9/1973 | Burup | 98/40 D |
| 3,776,121 | 12/1973 | Truhan | 98/36 |
| 3,803,995 | 4/1974 | Allander | 98/36 |
| 3,818,815 | 6/1974 | Day | 98/40 D |

*Primary Examiner*—Henry C. Yuen
*Attorney, Agent, or Firm*—Ross, Ross & Flavin

[57] ABSTRACT

Apparatus for generating a clean air zone, for example around a patient undergoing surgery or for a pharmaceutical or electronic clean room, has air supply means and air delivery means, inlets to the air supply means being distributed about the periphery of the apparatus so that clean air issuing from the delivery means travels first away from the delivery means, next outwardly from the center of the zone and finally inwardly to the inlets, thus sweeping an area larger than the size of the apparatus, and obviating the need for the apparatus to clean large quantities of ambient air.

2 Claims, 4 Drawing Figures

CLEAN AIR ZONE

This application is a continuation-in-part of Ser. No. 758,926; filed Jan. 13, 1977, now U.S. Pat. No. 4,094,232.

FIELD OF THE INVENTION

This invention relates to apparatus for generating a clean air zone, for example in an operating theatre, in a pharmaceutical "clean room" where drugs or chemicals are being prepared or processed, or in an electronics "clean room" wherein electronic components are assembled.

DISCUSSION OF THE PRIOR ART

Many installations for this purpose are known which rely on a downwardly flowing stream of clean air to sweep a desired clean area and discourage or prevent contamination approaching the working area. One known installation provides for a whole room to have air supplied through its ceiling and withdrawn at the base of the room. However this needs to be incorporated at the design stage of the building, and is very expensive. Other known installations have downward clean air flows enclosed in solid walls or walls of high speed air (a so-called "air-curtain"). Unfortunately the solid walls heavily restrict access to the working area and the approach of workers via doors enables contamination to enter. The air-curtain has the disadvantage that when broken it actively encourages the entrainment of contamination into the slower-moving air inside it, and can also "stir-up" contamination from the floor. Both these latter installations also have the disadvantage that the clean area generated is only of the same or smaller area than the air supply apparatus, and thus, if a large clean area is needed, a correspondingly larger, and thus more expensive apparatus, is required. Many known installations are also not re-circulatory, which, although it does not impair the efficiency of the apparatus, means that the input to the supply apparatus is substantially of ambient "dirty" air. This has the effect that the usual filters in the air supply apparatus have to cope with a constant flow of "dirty" air and must be cleaned at relatively frequent intervals.

OBJECTS OF THE INVENTION

An object of the present invention is to provide an improved apparatus for generating a clean air zone, wherein some or all of the above disadvantages are obviated or minimised.

The apparatus is conveniently in the form of a canopy having a common plenum chamber or a plurality of plenum chambers supplying the delivery means which can be of different permeabilities to provide the different air speeds.

Distribution of the inlets about the periphery of the apparatus has the effect of creating a clean zone which extends a considerable distance outside the area of the apparatus itself. This is in contradistinction to known apparatus, wherein inlets have been provided at floor level or at one side only. The inlets must be distributed so that a generally symmetrical air flow is generated beneath and around the apparatus.

BRIEF STATEMENT OF THE INVENTION

The present invention provides apparatus for generating a clean air zone wherein inlets to the apparatus are distributed about the apparatus.

The invention further provides apparatus for generating a clean air zone, comprising: air delivery means for delivering a flow of clean air to the zone; air supply means for supplying air to the air delivery means; cleansing means for cleaning the air and inlets to the supply means distributed around the apparatus.

The invention still further provides apparatus for generating a clean air zone comprising: a housing and air delivery means; cleansing means and air supply means in the housing, and inlets to the air supply means distributed around the periphery of the housing.

DESCRIPTION OF A PREFERRED EMBODIMENT

A preferred embodiment of apparatus 10 conforming to the invention is suitable for attachment to the ceiling of an operating theatre to provide a clean air zone around a patient undergoing surgery, or to the ceiling of a pharmaceutical or electronics clean room to provide a clean air zone around a machine or a manufacturing process. Instead of being ceiling mounted, the apparatus could be wall-mounted, or mounted on a wheeled frame to render it mobile and to enable it to be moved from, say, one machine to another.

Figure 2:
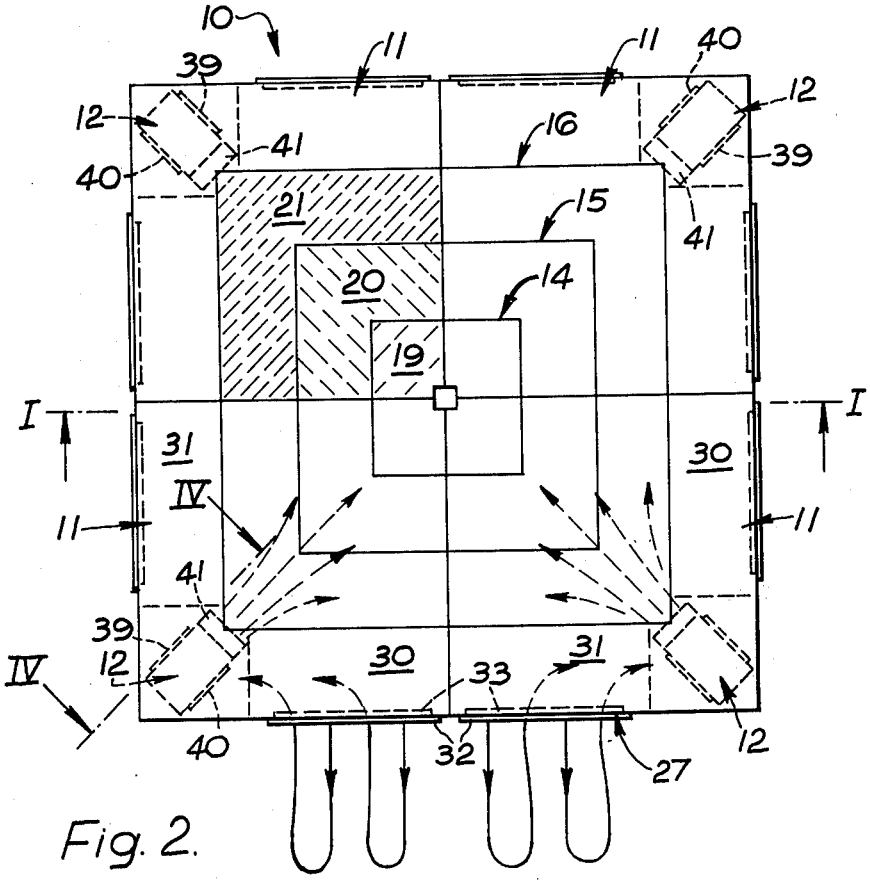
FIG. 2 is an inverted plan view of the apparatus of the invention.
Figure 3:
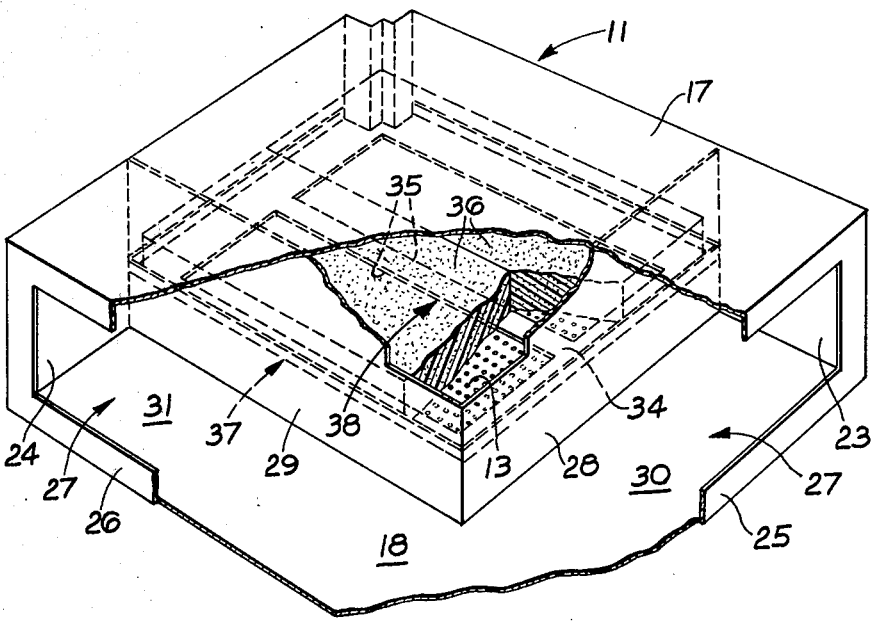
FIG. 3 is a fragmentary perspective cut-away view of one module forming part of the apparatus of the invention, parts having been omitted for clarity.

The apparatus 10 is in the form of a unit constructed from four modules 11, one of which is shown in detail in FIG. 3. Each unit thus has four air supply means constituted by fans 12, and three air delivery means (FIG. 2) constituted by areas of diffuser plates 13 of the modules.

A central one of the air delivery means is in the form of a square panel 14 of relatively high permeability (i.e. it has more and/or larger apertures than the other air delivery means) and in use delivers air at a linear velocity from 90–130 f.p.m. (preferably 110 f.p.m.). A second of the air delivery means is in the form of a panel 15 surrounding panel 14 and so perforated as to deliver air at a linear velocity of 60–90 f.p.m. (preferably 75 f.p.m.). A third of the air delivery means in the form of a panel 16 surrounding panel 15 and so perforated as to deliver air at a linear velocity of 20–60 f.p.m. (preferably 40 f.p.m). It must be noted, however, that whilst the velocities of the flows from the delivery means can vary, there must always exist a differential between adjacent flows of at least 5 f.p.m. and preferably over 20 f.p.m.

As has been previously mentioned, the apparatus 10 is in the form of a unit constructed from four modules 11. Referring now to FIG. 3, each module 11 is made of sheet metal and has a generally square top plate 17, an L-shaped base plate 18 and a rectangular perforated diffuser plate 13. Plate 13 has three distinct areas of different permeability (indicated by the variable crosshatching at 19, 20, 21 in FIG. 2) to achieve the aforesaid different flow velocities. Each plate 13 is hinged at 22 (FIG. 1) to facilitate servicing and cleaning.

The module 11 has closed inner adjacent side walls 23, 24 and side walls 25, 26 each having an elongate inlet window 27. Parallel to these latter walls and along the inner edges of the L-shaped base plate extend internal walls 28 and 29 which help to define an inner compartment of the module and fan inlet chambers 30 and 31. Each inlet window is closed by a hinged panel 32 (FIGS. 1 and 2) carrying a pre-filter pad 33 for removing coarse contaminants from incoming air.

Figure 4:
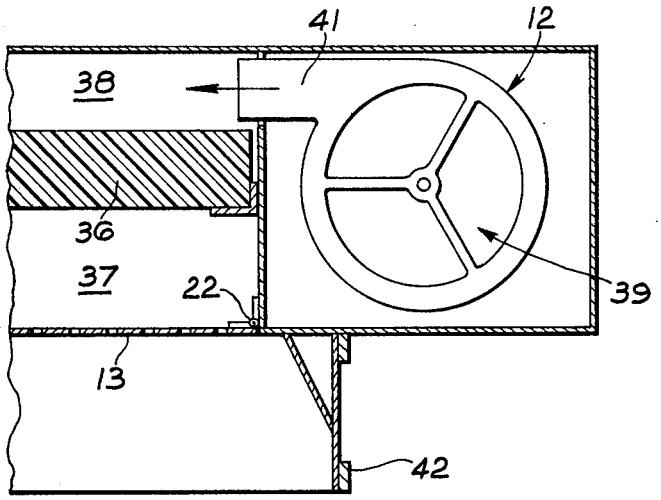
FIG. 4 is an enlarged fragmentary cross-section on the line IV—IV of FIG. 2, showing details of the fan.

The inner compartment of module 11 has a shallow sheet metal tray 34 therein which has apertures 35 and which supports filter pads 36. Below the tray 34 and above the plate 13 is a plenum chamber 37 and above the pads 36 and below top plate 13 is an intake chamber 38 to which air is supplied by fan 12 (FIG. 4). The fan 12 has been omitted from FIG. 3 for clarity.

Turning now to FIG. 4, it will be seen that each fan 12 is a conventional radial flow fan having two axial inlets 39 and 40 and a tangential outlet 41 which discharges into intake chamber 38. The inlets 39 and 40 face and take air from fan inlet chambers 30 and 31. The rotor and integral electric motor of the fan have not been illustrated as they form no part of the present invention.

Figure 1:
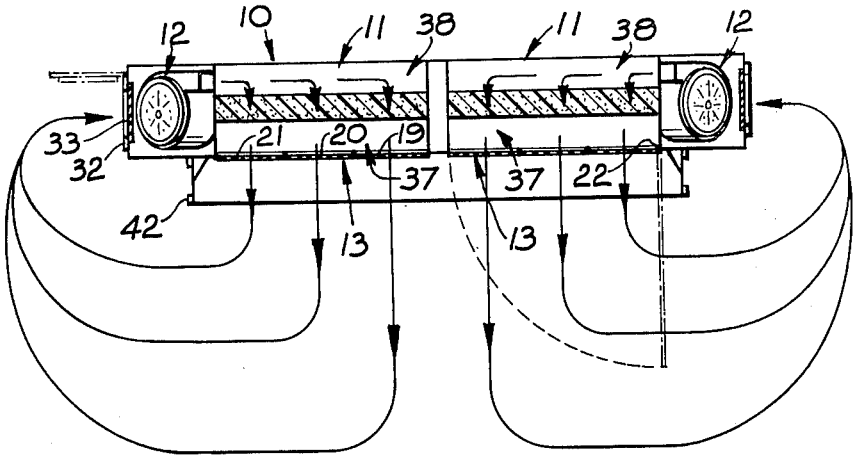
FIG. 1 is a transverse cross-sectional schematic view of a preferred apparatus of the invention, the cross-section taken on the line I—I of FIG. 2.

From the arrows in FIGS. 1 and 2, it will be appreciated that a basically re-circulating air system is employed, thus generating a clean zone beneath the air delivery means and a swept air zone surrounding the delivery means. This results in a clean zone of effectively larger area than the area of the apparatus 10. The recirculating feature also means that the filters have to be replaced at less frequent intervals as they are not continuously filtering dirty ambient air as they would be in a non-circulatory system.

A short canopy 42 (FIG. 1) can be provided to give some guidance to the downwardly flowing air.

It will be appreciated that the present invention is equally applicable to apparatus wherein only a single stream of air is provided, the distributed inlets still providing the increased area feature and encouraging a downwardly, outwardly and then upwardly flowing air stream. There is always a flow of air away from the centre of the zone which inhibits the ingress of contamination, even from objects and persons entering the outer areas of the zone.

The apparatus can be wall mounted, and generate a downward flow, in which case flow would be outwards from three sides of a rectangular area, the inlets being distributed about the three free sides of the apparatus. As a further alternative, the apparatus could be mounted (for example on a wall) to supply air travelling initially in a horizontal direction, the distributed inlets encouraging the same flow away from the centre of the cleaned zone. The apparatus can also direct air at any other convenient practicable angle to generate a clean air zone as may be desired.

I claim:

1. Apparatus for generating a clean air zone comprising: a rectangular housing having a plenum chamber and a lower face and perimetral lateral side walling including a plurality of side faces each having an air inlet therethrough, a filter below the inlets within the housing between the plenum chamber and lower face, a fan in each corner of the housing for drawing air from the surrounding area and through the inlets and into the plenum chamber, the lower face including a diffuser constituting an air delivery means having areas of different permeabilities for supplying air to the space therebeneath, the areas of different permeabilities being determined by differing numbers of apertures and/or differing sizes of apertures in the different areas, all adapted and arranged with air discharged through the air delivery means passing firstly through the areas of different permeabilities and downwardly into the corresponding spaces therebelow and secondly laterally outwardly and thirdly upwardly toward the inlets for sweeping a volume greater than the volume of the said spaces in the generation of a clean air zone having a perimeter outside the perimeter of the lower face.

2. Apparatus for generating a clean air zone comprising: a housing having a lower one face and perimetral lateral side walling, an air delivery means having an air outlet in the one face for supplying air to the space beneath the one face, and air inlets distributed about the perimetral lateral side walling so that air from the outlet passes firstly downwardly into the space directly below the one face and secondly laterally outwardly of the space and thirdly back and upwardly towards the inlets so as to sweep a volume greater than the volume of the space directly beneath the one face to generate a clean air zone whose perimeter lies outside the perimeter of the one face, with the lateral side walling of the housing including a plurality of faces, each face having at least one of the inlets, the housing being rectangular and a fan being provided at each corner thereof, each fan having an extended inlet in the respective side wall of the housing on either side thereof; each fan discharging air into a plenum chamber within the housing above a filter which lies above the air delivery means; the delivery means being in the form of a diffuser, the different permeabilities being achieved by the provision of areas having different numbers of apertures.

* * * * *